US005711400A

United States Patent [19]

Tan

[11] Patent Number: 5,711,400

[45] Date of Patent: Jan. 27, 1998

[54] MOUNTABLE WORK PLATFORM FOR A LADDER

[76] Inventor: Su-Fen Tan, 4th Floor, 243 Juikuang Road, Neihu, Taipei 114, Taiwan

[21] Appl. No.: 832,053

[22] Filed: Apr. 2, 1997

[51] Int. Cl.[6] ..... E06C 5/44

[52] U.S. Cl. ..... 182/119; 182/222

[58] Field of Search ..... 182/119, 222, 182/115, 118, 117

[56] References Cited

U.S. PATENT DOCUMENTS 5,358,069 10/1994 Krause ..... 182/119

FOREIGN PATENT DOCUMENTS 2 501 267 10/1982 France ..... 182/222

*Primary Examiner*—Alvin C. Chin-Shue

*Attorney, Agent, or Firm*—Bucknam and Archer

[57] ABSTRACT

The present invention relates to a mountable work platform for use on a ladder, comprising a long plate and a short plate. The long plate and the short plate each further comprise a plurality of plates, arranged in a row and connected by a connection bar and a clamp bar, where a stable assembly is attained by protrusions of the connection bar and the clamp bar holding depressions on the plates. The connection bars of the long plate and of the short plate together embrace a step of the ladder, and the clamp bars of the long plate and of the short plate each hold another step of the ladder in a grip. The long plate and the short plate are independently usable as a table on the ladder, when the ladder is folded.

1 Claim, 5 Drawing Sheets

MOUNTABLE WORK PLATFORM FOR A LADDER

BACKGROUND OF THE INVENTION

Field of the Invention

The present invention relates to a work platform for use on a ladder, particularly to a work platform, which is mountable by simply connecting the structural parts.

In the Australia petty patent application no. 65629/96 "Work platform for a ladder" a work platform of two plates is described, which substitutes a conventional wooden work platform and is mounted by clamps on the steps of a foldable ladder. Such a work platform is stable as well as easy to use and to fold away.

The present invention aims at further improving the work platform. Both plates are independently attachable by clamp elements on the steps of a foldable ladder, making mounting and dismounting them easier. When the foldable ladder is not used, the plates can be used as a table on the folded ladder. Moreover, the work platform of the present invention is assembled by simply connecting the structural parts, without any need of nails or rivets.

SUMMARY OF THE INVENTION

The main feature of the present invention consists in mounting the two plates independently on a foldable ladder.

Another feature of the present invention is the usability of the plates as tables on the folded ladder.

A further feature of the present invention is the assembly of each of the two plates by connecting the structural parts thereof, leading to simplified production with reduced cost.

The present invention can be more fully understood by reference to the following description and accompanying drawings, which form an integral part of this application.

DETAILED DESCRIPTION OF THE PREFERRED EMBODIMENT

Figure 1:
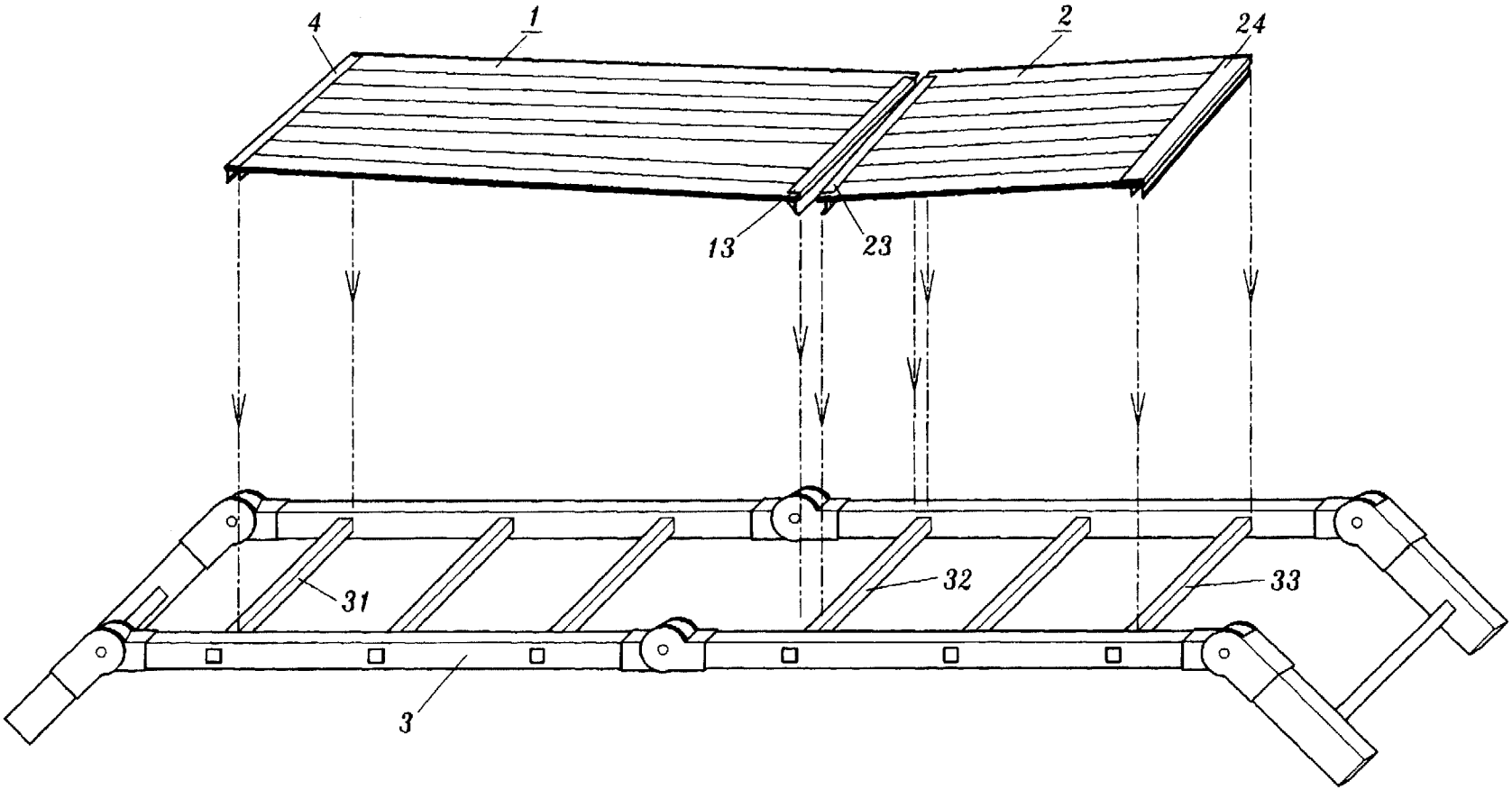
FIG. 1 is a perspective view of the mountable work platform for a ladder of the present invention, together with the foldable ladder to be covered.
Figure 2:
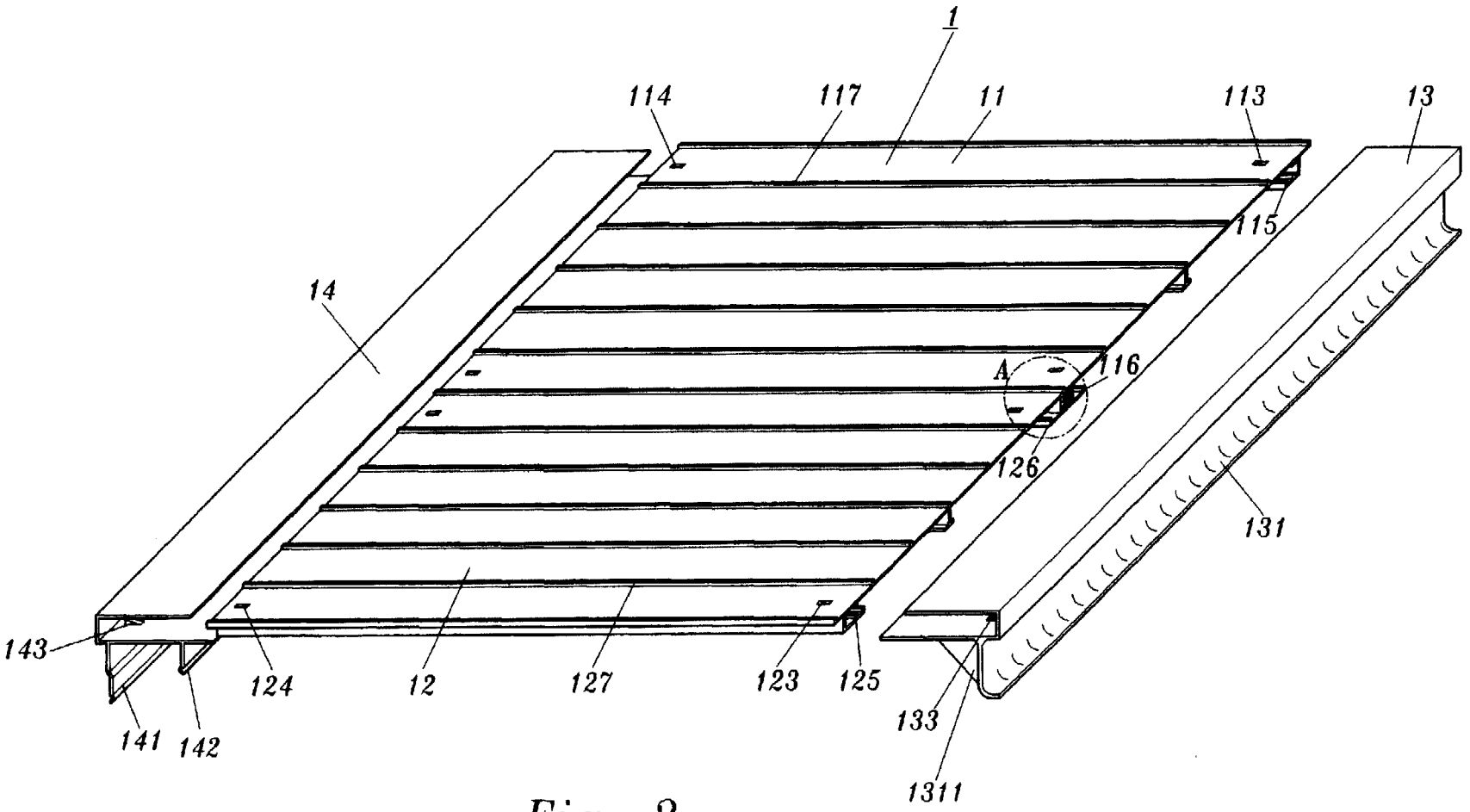
FIG. 2 is a perspective view of the left plate of FIG. 1 in a shortened representation.

Referring to FIG. 1, the mountable work platform for a foldable ladder of the present invention has a long plate 1 and a short plate 2. The work platform is attached on steps 31, 32 and 33 of the ladder. Throughout the following description a position of the long plate 1 to the left of the short plate 2 is assumed, with a longitudinal axis from the left to the right. To the left, the long plate 1 ends in a transverse clamp bar 14, to the right, in a transverse connection bar 13. The clamp bar 14 is attached to step 31 of the ladder, the connection bar 13 embraces the left half of step 32 of the ladder. To the right, the short plate 2 ends in a transverse clamp bar 24, to the left, in a transverse connection bar 23. The clamp bar 24 is attached to step 33 of the ladder, the connection bar 23 embraces the right half of step 32 of the ladder.

As shown in FIG. 1, the long plate 1 comprises two adjoining half plates 11, 12, abutting each other along the longitudinal axis. Close to each of the right corners, on both the upper and the lower side, the half plate 11 has small depressions 113, having inclined bottom surfaces. On the lower side, along the longitudinal edges of the half plate 11, support bars 115, 116 with L-shaped symmetric cross-sections are attached. Close to each of the right corners, on both the upper and the lower side, the half plate 12 has small depressions 123, having inclined bottom surfaces. On the lower side, along the longitudinal edges of the half plate 12, support bars 125, 126 with L-shaped symmetric cross-sections are attached. In the depressions 113, 123, the connection bar 13 is held. Close to each of the left corners, on both the upper and the lower side, the half plate 11 has small depressions 114. The form and positions of the depressions 114 correspond to the form and positions of the depressions 113. Close to each of the left corners, on both the upper and the lower side, the half plate 12 has small depressions 124. The form and positions of the depressions 124 correspond to the form and positions of the depressions 123. In the depressions 114, 124, the clamp bar 14 is held. On the upper surface of the half plates 11 and 12 several anti-slip stripes 117 and 127 are affixed for safe standing on the work platform.

The cross-section of the connection bar 13 is shaped like the letter U, open towards the half plates 11 and 12, with an upper and a lower leg. From the lower leg, an embracing part 131 extends downwards and, after a turn of 90°, to the right. The inner side of the upper and lower leg of the connection bar 13 has small protrusions 133 in positions that correspond to the positions of the depressions 113, 123 on the half plates 11, 12. When the connection bar 13 is put on the common right edge of the half plates 11, 12, the protrusions 133 glide into the depressions 113, 123, where they are held. For better stability, the embracing part 131 is supported from the left by a plurality of support plates 1311.

The cross-section of the clamp bar 14 is shaped like the letter U, open towards the half plates 11 and 12, with an upper and a lower leg. From the lower leg, a first clamp plate 141 and a second clamp plate 142 extend downwards, the second clamp plate 142 placed to the right of and extending not as far as the first clamp plate 141. The inner side of the upper and lower leg of the clamp bar 14 has small protrusions 143 in positions that correspond to the positions of the depressions 114, 124 on the half plates 11, 12. When the clamp bar 14 is put on the common left edge of the half plates 11, 12, the protrusions 143 glide into the depressions 114, 124, where they are held.

Figure 3:
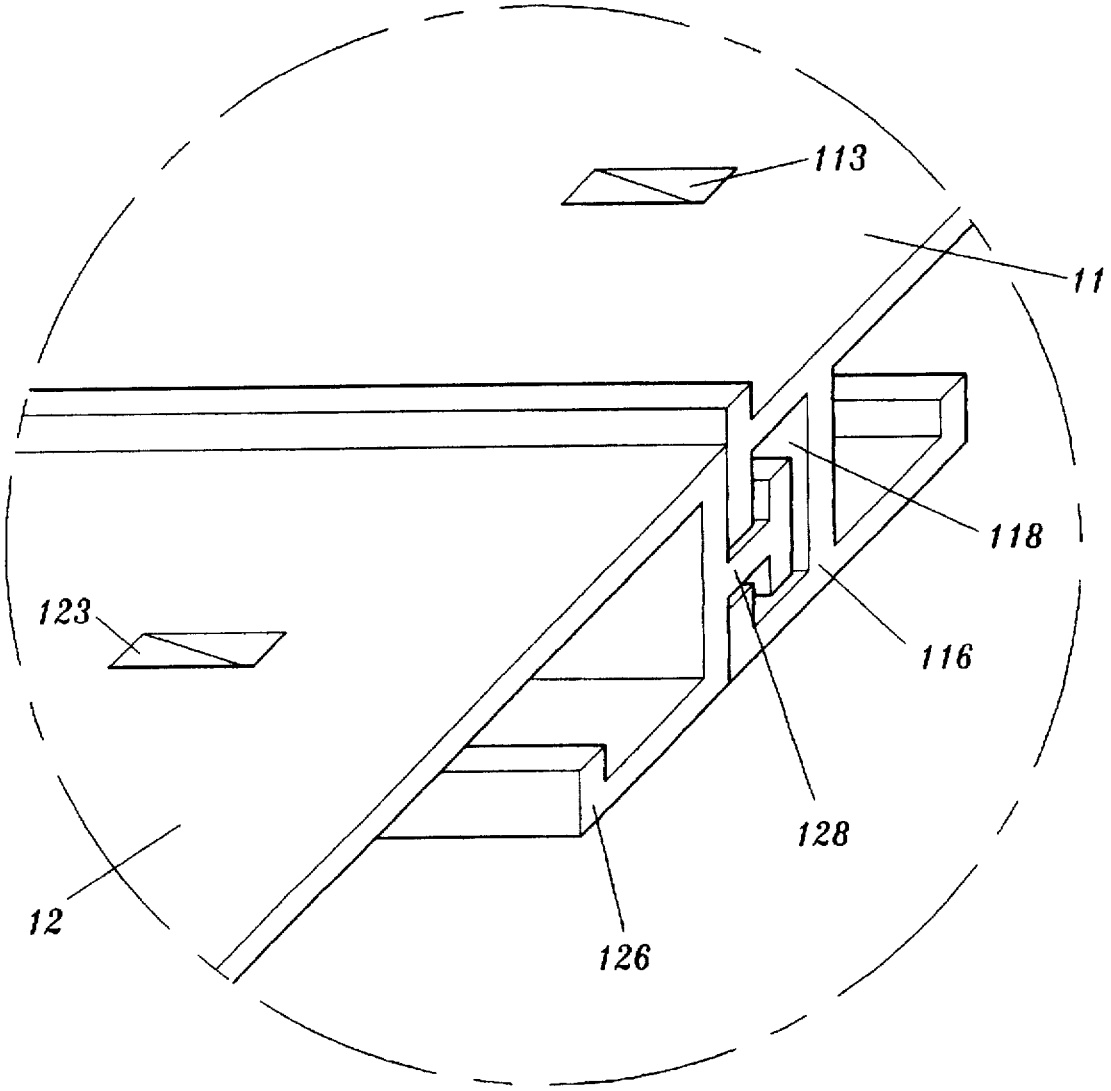
FIG. 3 is an enlarged detail of the area A within FIG. 2 that is circled with a dash-dotted line.

As shown in FIG. 3, the support bar 116 of the half plate 11 has a groove 118 on the surface that contacts the support bar 126 of the half plate 12. The support bar 126 has a ridge 128 towards the support bar 116. The cross-section of the ridge 128 is shaped like the letter T. It fits into the groove 118, ensuring a stable connection of the half plates 11 and 12. FIG. 3 also shows the elongated form and the inclined bottom surfaces of the depressions 113, 123.

Figure 4:
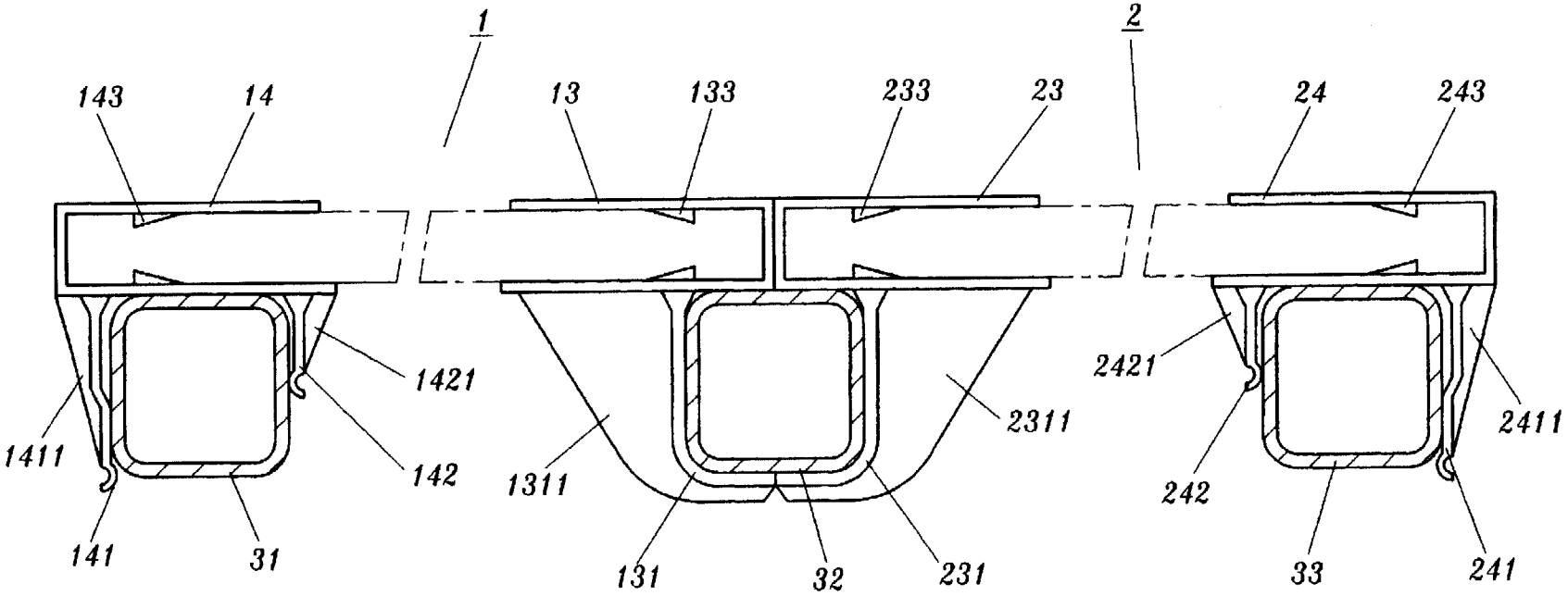
FIG. 4 is a cross-sectional view of the two clamp bars and connection bars of the present invention.

Referring to FIG. 4, the lower leg of the connection bar 13 and the embracing part 131 embrace the left half of step 32. The first and second clamp plates 141, 142 hold step 31 in a grip.

The structural parts of the short plate 2 are arranged as the structural parts of the long plate 1, mirrored on a plane perpendicular to the longitudinal axis. The short plate 2 comprises two adjoining half plates 21, 22, abutting each other along the longitudinal axis. To the left, facing the long plate 1, the short plate 2 ends in a transverse connection bar 23, to the right, in a transverse clamp bar 24. From the connection bar 23, an embracing part 231 extends downwards and to the left, together with the connection bar 23 embracing the right half of step 32. From the clamp bar 24, a first clamp plate 241 and a second clamp plate 242 extend downwards, the second clamp plate 242 placed to the left of and extending not as far as the first clamp plate 241. The clamp plates 241 and 242 hold step 33 in a grip. The connection bar 23 has protrusions 233, corresponding to the protrusions 133 of the connection bar 13. The clamp bar 24 has protrusions 243, corresponding to the protrusions 143 of the clamp bar 14. For better stability, the embracing part 231 is supported from the left by a plurality of support plates 2311. Similarly, the clamp plates 141, 242 are supported by support plates 1411, 2421 from the left, and the clamp plates 142, 241 are supported by support plates 1421, 2411 from the right.

To use the work platform of the present invention, the connection bars 13, 23 of the long plate 1 and the short plate 2 are from opposite sides put around step 32 of the ladder. Then the clamp bar 14 of the long plate 1 and the clamp bar 24 of the short plate 2 are pressed down on steps 31 and 33 of the ladder. Since the long plate 1 and the short plate 2 are not connected, mounting the work platform is easy. Moreover, assembling the long plate 1 and the short plate 2 by connecting half plates, connection bar and clamp bar is simple.

Figure 5:
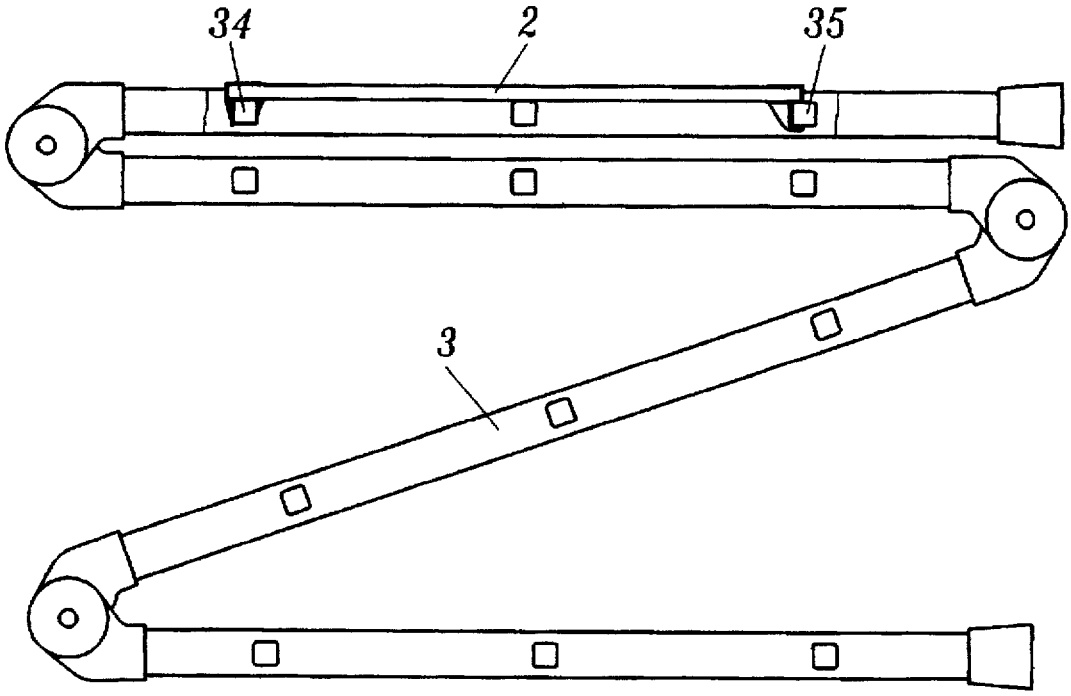
FIG. 5 is a perspective view of one of the plates of the mountable work platform for a ladder of the present invention, when used as a table on the folded ladder.

Both plates of the work platform of the present invention are independently usable. Referring to FIG. 5, the short plate 2 is put on two steps 34, 35 of a horizontal section of the folded ladder, serving as a table.

While the invention has been described with reference to a preferred embodiment thereof, it is to be understood that modifications or variations may be easily made without departing from the spirit of this invention which is defined by the appended claims.

What is claimed is:

1. A mountable work platform for use on a ladder, comprising two plates of different length and equal width, each of said plates in turn comprising:

a plurality of rectangular single plates, arranged next to each other with abutting longitudinal edges, common first and second lateral edges, a common upper side and a common lower side, and four corners each, each of said single plates having, in a symmetrical arrangement, on both said upper side and said lower side, close to said first and second edge near said corners, depressions with an inclined bottom side, one of every pair of neighboring single plates having a ridge along the abutting longitudinal edge with a T-shaped cross-section, the other having a groove along the abutting longitudinal edge, into which said ridge with a T-shaped cross-section fits, such that said single plates are stably connected;

a connection bar along said first lateral edge of said single plates, having a U-shaped cross-section with a base at an outward side, an upper leg and a lower leg with inner surfaces, said inner surfaces being provided with protrusions, which fit into said depressions of said plates close to said first lateral edge, while an embracing part extends from said lower leg downwards and, after a turn of 90°, outwards; and a clamp bar along said second lateral edge of said single plates, having a U-shaped cross-section, with an upper leg and a lower leg with inner surfaces, said inner surfaces being provided with protrusions, which fit into said depressions of said plates close to said second edge, a first clamp plate extending downwards and a second clamp plate extending, less far than said first clamp plate, downwards;

wherein said plates are adapted to be placed on said ladder, such that said connection bars of said long plate and of said short plate together embrace a step of said ladder and said clamp bars of said long plate and of said short plate each hold another step of said ladder in a grip.

* * * * *